United States Patent [19]

Hell

[11] Patent Number: 4,682,562

[45] Date of Patent: Jul. 28, 1987

[54] HOLDING DEVICE FOR METAL SECTIONS WHICH ARE TO BE COATED IN TWO COLORS

[75] Inventor: Uwe Hell, Trappenkamp, Fed. Rep. of Germany

[73] Assignee: Hell GmbH & Co., Trappenkamp, Fed. Rep. of Germany

[21] Appl. No.: 845,138

[22] PCT Filed: May 30, 1985

[86] PCT No.: PCT/DE85/00185

§ 371 Date: Jan. 28, 1986

§ 102(e) Date: Jan. 28, 1986

[87] PCT Pub. No.: WO85/05573

PCT Pub. Date: Dec. 19, 1985

[30] Foreign Application Priority Data

Jun. 1, 1984 [DE] Fed. Rep. of Germany ..... 3420453

[51] Int. Cl.[4] ..... B05C 13/00; B05C 13/02

[52] U.S. Cl. ..... 118/500; 118/504; 118/505; 118/301; 427/282

[58] Field of Search ..... 118/500, 501, 504, 505, 118/301, 323, 324, 721, 503; 427/282

[56] References Cited

U.S. PATENT DOCUMENTS

| | | | |
|---|---|---|---|
| 640,086 | 12/1899 | Braddock | 118/500 |
| 1,072,810 | 9/1913 | Beasejour | 118/500 |
| 1,106,915 | 8/1914 | Beasejour | 118/500 |
| 1,231,246 | 6/1917 | Florsheim et al. | 118/500 |
| 1,573,082 | 2/1926 | Madden . | |
| 1,817,928 | 8/1931 | Panitzsch | 118/505 |
| 1,838,701 | 12/1931 | Nicolai | 118/500 |
| 2,588,557 | 3/1952 | Morris et al. | 118/503 |
| 2,699,144 | 1/1955 | Peterson | 118/500 |
| 2,730,461 | 1/1956 | Vawter | 118/323 |
| 3,197,797 | 8/1965 | Stanley | 118/503 |
| 4,129,092 | 12/1978 | Wiggins | 118/323 |

*Primary Examiner*—Sam Silverberg
*Assistant Examiner*—Terry J. Owens
*Attorney, Agent, or Firm*—Balogh, Osann, Kramer, Dvorak, Genova & Traub

[57] ABSTRACT

A holding device for holding items which are to be treated in different colors has a frame comprising a pair of spaced cross members supporting therebetween a series of bearers which have extending arms supporting a plurality of masks which are movable with respect to each other and with respect to the items to define a continuous wall surface to isolate both sides of the item for application of different color treatments.

15 Claims, 5 Drawing Figures

HOLDING DEVICE FOR METAL SECTIONS WHICH ARE TO BE COATED IN TWO COLORS

BACKGROUND OF THE INVENTION

1. Field of the Invention

The invention relates to a holding device for metal sections which are to be coated in two colours under utilisation of a movable frame comprising a top cross member and bearers on which the metal sections are to be secured.

2. Description of the Related Art

The powder enamelling method is preponderantly also applied apart from the anodising process, for coloured coating of metal sections which are utilised for production of windows, doors or gates. To this end, the metal sections required in each case are provided with the coloured powder required, which is caused to melt in a furnace, or exposed to the anodising process.

Problems arise if the inner and outer secton elements of complete metal sections, for example intended for windows or doors, are to be two-coloured, or if the one side is to be enamelled and the other side is to be anodised. To this end, the procedure applied is that the sections for indoors and the sections for outdoors are anodised of enamelled separatedly and are then joined together by means of connecting webs of plastics material for preference.

This method of production of two-coloured complete metal sections is comparatively costly because of the considerable waste of sectional material and an increased risk arises upon bonding the product since the connection between inner and outer metal sections finish-processed in different colours by means of the said connecting webs is not as successful qualitatively as in the case of metal sections which are superficially unprocessed, because the colour-finished metal sections may not incur any scratches or other damage during the further processing of the sections, so that great care must consequently be exercised. Furthermore, the production of bonded separate sections is affected by limits inasmuch as bonded sections cannot be utilised for larger windows and doors for example, for static reasons. A single section which is cross-sectionally sufficiently large and stable has to be selected for this purpose, which may however be produced in one colour only at acceptable costs, in view of the desirable quality of enamelling.

SUMMARY OF THE INVENTION

The object of the invention consists in devising a holding device for metal sections which are to be coated in two colours, which renders it possible to provide finished metal sections, in respect of the cross-sectional outline, and even those of larger cross-section, with two colours in an economic manner.

The solution of this problem is based on a holding device in the form of a frame for metal sections which are to coated, and is characterised in that the metal sections may be secured mutually parallel on the frame under interpositioning of masks, in such manner that the masks in each case bear against mutually opposed sides of adjacent sections and form a continuous wall with these.

Metal sections utilised for windows and doors in particular may be produced economically in two colours in a simple manner, by means of the holding device according to the invention. To this end, the metal sections which are to be provided with two colours are mounted in the frame whilst extending mutually parallel and with mutual spacing, the gaps between them being filled with the masks so that a continous wall of metal sections and masks is formed. The device, together with the metal sections, is then conveyed into a chamber in which the section surfaces at the one side of the masks are coated with the required coloured powder. The same procedure is repeated in another chamber on the other side of the masks, with the other coloured powder. The powder coating of different colours of the sections is then exposed to the finishing treatment in a stove enamelling furnace.

This has the result that the separate sections which are to be joined together by means of plastics material webs need no longer be joined together after the powder enamelling operation in different colours but already prior to the same, i.e. the window manufacturers may procure finished whole sections, as regards the sectional composition of the whole section required, from the manufacturers of the sections, their liability risk being reduced thereby. The scrap loss is also reduced moreover. Furthermore, it is now also possible to produce statically more rigid metal sections, e.g. which have to be utilised for large windows and doors, economically in two colours. The holding device according to the invention also renders it possible for the section in question to be anodised on the one side and provided with the required coloured powder coating on the other side. Regarding the said assembled sections, it is now also possible to adhere to shortened delivery periods, since finished assembled sections may be procured immediately from the manufacturers of sections or the like, thereby also eliminating the danger of damage to the subsequent enamel coating whilst joining separate sections together.

BRIEF DESCRIPTION OF THE DRAWINGS

The invention is described in particular in the following in respect of an example of embodiment illustrated in the accompanying drawings. In these drawings and in diagrammatical illustration.

DESCRIPTION OF THE PREFERRED EMBODIMENT

Figure 1:
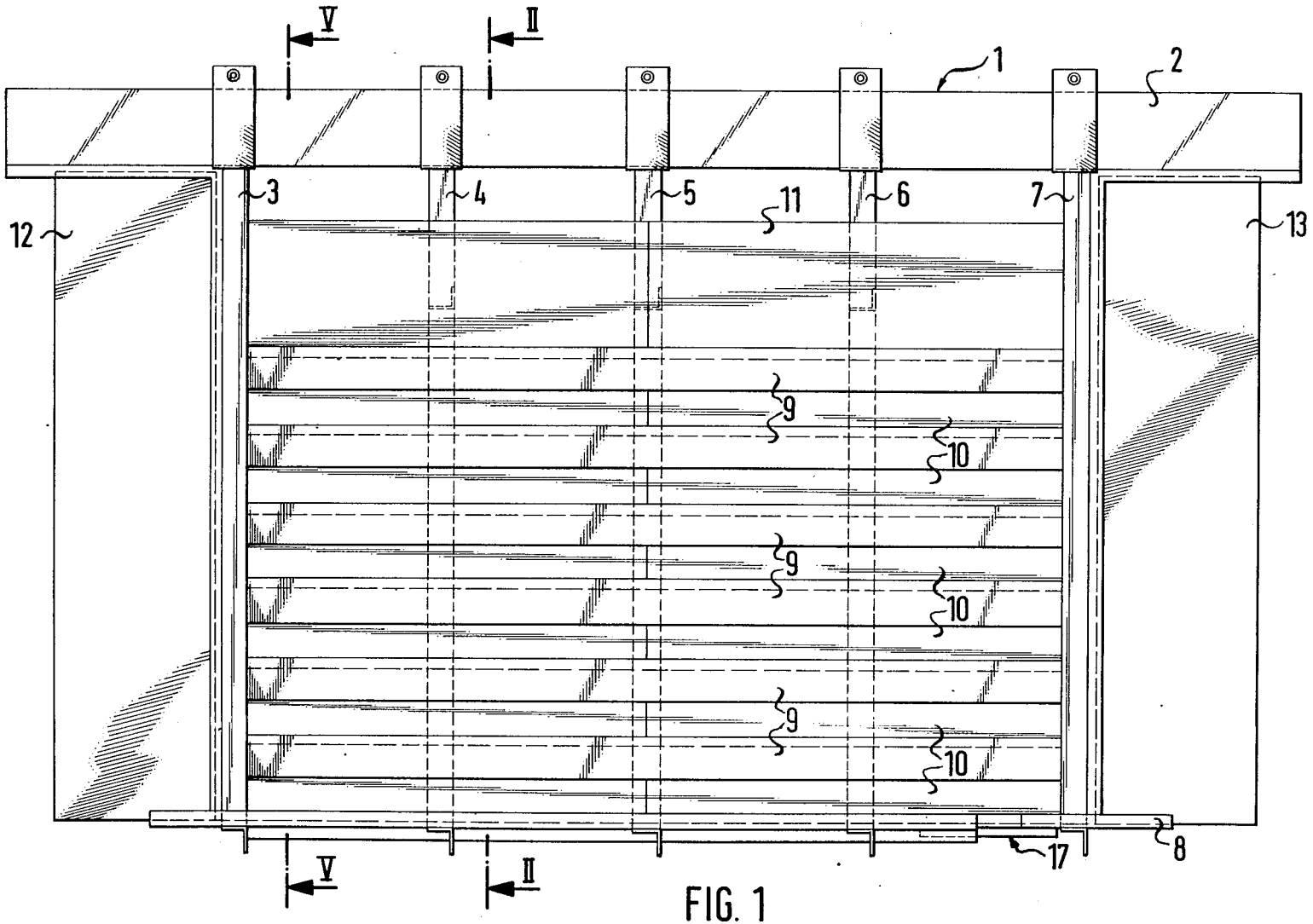
FIG. 1 shows a sideview of the example of embodiment.

According to FIG. 1, a frame 1 is provided which comprises a top cross member 2, several bearers 3,4,5,6 and 7 suspended from the former, as well as a bottom cross member 8 connected to the lower extremities of the bearers. The bearers 3 to 7 have a mutual spacing which is varible as regards the bearer 7, the bearer being formed to be displaceable on the cross members.

Figure 2:
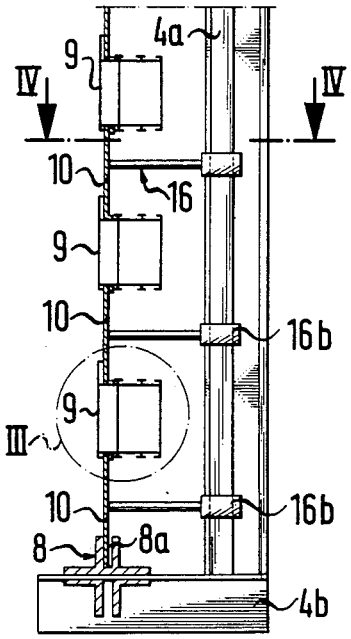
FIG. 2 shows a cross-section along the line II—II in FIG. 1.
Figure 5:
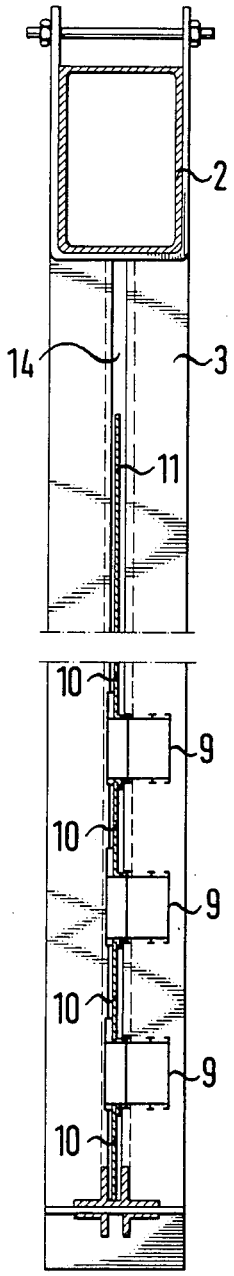
FIG. 5 shows a cross-section along the line V—V in FIG. 1.

As more clearly apparent from FIGS. 2 and 5, the metal sections 9, e.g. of aluminium, which are to be received by the holding device and are to be coated, extend in horizontal position, that is to say in such manner that a mask or shutter mask 10 is provided initially at the very bottom, which is laterally supported on the cross member 8 and strands on edge, on which is supported a metal section 9, whereon a mask 10 is again supported, followed again by a metal section 9, and so on. On the topmost metal section 9 is then supported a top cover plate 11 which covers the gap between the topmost section 9 and the cross member 2. Lateral and vertically extending masks 12 and 13 are also provided furthermore, which are in each case supported on the top cross member 2, on the two outer lateral bearers 3 and 7, as well as on extensions of the lower cross member 8, at the bottom. These masks are equally removable, for which purpose they are located in slots formed by flanges of angle iron, as apparent from FIG. 1. A slot form referred to is more clearly recognisable in FIGS. 2 and 5 at the bottom.

Figure 3:
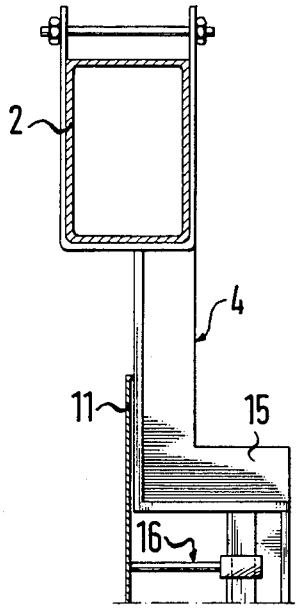
FIG. 3 shows a detail corresponding to III in FIG. 2.
Figure 3:
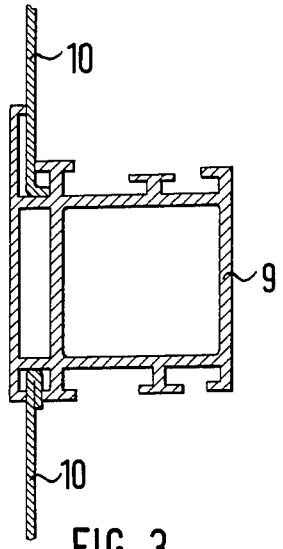

FIGS. 1,2 and 5 show that the masks 10, which preferably consist of sheet metal, are arranged on edge in the holding device 1, in their areal extension. To this end, the two extreme bearers 3 and 7 are each provided with a locating slot 14 whereof the width is so devised that the masks 10, as well as the two mask panel 11, may conveniently be pushed through or into the slot in question and may also be vertically retained therein, as clearly shown in FIG. 5. Since the vertical position of the masks 10 is thus secured by means of the vertical locating slot 14 of the extreme lateral bearers 3 and 7, the required position of the metal sections 9 which are to be coated, between the masks, is also secured at the same time, as clearly apparent from FIGS. 2,3 and 5. As apparent from FIG. 3 in particular, the masks 10 extending horizontally in their longitudinal direction engage in the metal sections 9 in such manner that the sections are supported on the masks 10 in the required position, are thus held for the period of their colour processing.

Figure 4:
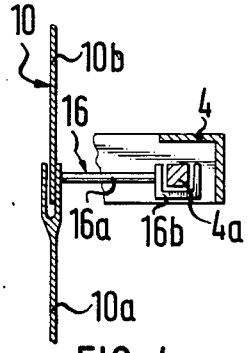
FIG. 4 shows a partial cross-section along the line IV—IV in FIG. 2.

It is thus apparent from FIGS. 1,2 and 5 that the metal sections form a continuous wall with the components of the holding device, so that it is possible to apply the required coloured powder coating in a processing chamber by means of spray guns, by the electrostatic method. Whilst doing so, the operation is performed at the one side of the device only, so that the other side of the device—inclusive of the metal sections—does not receive any application of powder. This application is then undertaken in another chamber in conventional manner. The whole holding device 1 is then conveyed together with the metal sections 9 into a stove enamelling surface, in which a fusing operation on the powder particles is undertaken in conventional manner. Whereas the extreme lateral bearers 3 and 7 extend rectilinearly and vertically, the other bearers 4,5, and 6 which are situated between the extreme bearers 3 and 7, are provided with cranked section 15 as apparent from FIG. 2. The reason for this consists in that if the masks 10 are provided with fixed supports 16, these supports may again be borne loose on the corresponding bearers 4, 5 and 6, as shown in FIG. 4. To this end, the bearer 4 is provided, for example, with an additional vertical bar 4*a*, which is for example enflanked in U-form by the support 16.

In the case of very long masks, it is advantageous to combine these from two mask strips 10*a* and 10*b*, the mutually allotted terminal portions of the mask strips 10*a*, 10*b* etc. partially overlapping each other in shape-locked manner, to which end the one strip extremity is preferably produce in U-shape according to FIG. 4. For example, a support arm 16*a* whereof the other extremity comprises an open holder 16*b*, which may for example equally be produced to U-shape, may then be secured on the U-shaped form of the one mask strip 10*a*. The shorter mask strips 10*a* and 10*b* may thus be handled more easily than a long mask, in which connection it is assured at the same time that the mask strips 10*a* and 10 *b* assure the required position of the cover strip in question at the point of their inter-engagement.

The cranked vertical bearers 4,5 and 6 have a short horizontal arm 4*b* etc, at their lower extremity, and the bottom cross member 8 is connected to each short arm. As already indicated earlier, this cross member has an upwardly open longitudinal slot 8*a* which partly receives the lowest mask 10 (FIG. 2). This slot 8*a*, of comparatively high structure assures that the lowest mask 10 cannot buckle under the action of the weight bearing on the same because of the superjacent metal sections 9 and other mask 10. Furthermore, the bottom cross member 8 is telescopically constructed in the area 17 (FIG. 1), so that it may be lengthened or shortened if the right-hand extreme bearer 7 is displaced in horizontal direction on the top cross member 2. For example, this may be the case if the length of the metal sections 9 which are to be coated, has changed.

The operation of the holding device described in the foregoing for two-colour coating of metal sections is already clearly apparent from the preceding statement, so that there is no need to go into further particulars on this subject. Let us merely state too that apart from the application of two different coloured powders, it is also possible with this device to produce metal sections which are anodised on one side and provided with the required coloured coating on the other side. The procedure then applied for anodising is such that the device described is immersed in an appropriate bath and that the anodising operation is then performed under application of electrical power in conventional manner. Finally, it is also possible for the sections 9 which are to be coated and the masks 10 which are to be situated between these to be installed vertically in the device 1, as well. THe cross members 2 and 8 are then provided with mounts such that the upper and lower extremities, respectively, of the parts 9 and 10 may be held fast.

I claim:

1. A holding and masking device for holding and masking items which are to be coated with two colors, said device comprising a frame having a top cross member, a bottom cross member spaced from said top cross member, a plurality of spaced bearers extending between said cross members and supported thereby, a plurality of support arms extending outwardly and loosely supported by said bearers, outer ends of said support arms, at least a pair of spaced masks supported by said outer ends of said support arms for receiving and holding at least one item, said masks and said item forming a continuous wall, whereby said masks isolate both sides of said item from each other for receiving different color treatments.

2. A holding and masking device according to claim 1 further comprising two vertically-extending masks, one located adjacent and external to each of the outer two of said plurality of spaced bearers.

3. A holding and masking device according to claim 16 wherein said bottom cross member has an upwardly open longitudinal slot for partial reception of the bottom one of said masks.

4. A holding and masking device according to claim 3 further comprising two vertically-extending masks, one located adjacent and external to each of the outer two of said plurality of spaced bearers.

5. A holding and masking device according to claim 1 wherein said items and masks may be stacked one above another in horizontal position.

6. A holding and masking device according to claim 5 wherein said spaced bearers contain locating slots through which said masks extend loosely, and said masks consist of sheet metal strips.

7. A holding and masking device according to claim 5 wherein each mask comprises two aligned and partially mutually-overlapping mask strips which engage one another in shaped-locked manner in the area of overlap, and one of each said two aligned and partically mutually-overlapping mask strips is provided with a support which acts against transverse displacement in the area of overlap.

8. A holding and masking device according to claim 5 further comprising two vertically-extending masks, one located adjacent and external to each of the outer two of said plurality of spaced bearers.

9. A holding and masking device according to claim 1 wherein said spaced bearers contain locating slots through which said masks extend loosely, and said masks consist of sheet metal strips.

10. A holding and masking device according to claim 9 wherein each mask comprises two aligned and partially mutually-overlapping mask strips which engage one another in shape-locked manner in the area of overlap, and one of each said two aligned and partially mutually-overlapping mask strips if provided with a support which acts against transverse displacement in the area of overlap.

11. A holding and masking device according to claim 9 further comprising two vertically-extending masks, one located adjacent and external to each of the outer two of said plurality of spaced bearers.

12. A holding and masking device according to claim 1 wherein each mask comprises two aligned and partially mutually-overlapping mask strips which engage one another in shape-locked manner in the area of overlap, and one of each said two aligned and partially mutually-overlapping mask strips is provided with a support which acts against transverse displacement in the area of overlap.

13. A holding and masking device according to claim 12 further comprising two vertically-extending masks, one located adjacent and external to each of the outer two of said plurality of spaced bearers.

14. A holding and masking device according to claim 12 wherein said supports have supporting arms fastened one on each of said masks, and the end of each said support arm facing away from each said mask has an open holder which fits loosely around one of said spaced bearers.

15. A holding and masking device according to claim 14 further comprising two vertically-extending masks, one located adjacent and external to each of the outer two of said plurality of spaced bearers.

* * * * *